US007621150B2

(12) United States Patent
Kadle et al.

(10) Patent No.: US 7,621,150 B2
(45) Date of Patent: Nov. 24, 2009

(54) INTERNAL HEAT EXCHANGER INTEGRATED WITH GAS COOLER

(75) Inventors: Prasad Shripad Kadle, Williamsville, NY (US); Xiaoxia Mu, East Amherst, NY (US)

(73) Assignee: Delphi Technologies, Inc., Troy, MI (US)

( * ) Notice: Subject to any disclaimer, the term of this patent is extended or adjusted under 35 U.S.C. 154(b) by 334 days.

(21) Appl. No.: 11/650,223

(22) Filed: Jan. 5, 2007

(65) Prior Publication Data

US 2008/0163644 A1 Jul. 10, 2008

(51) Int. Cl.
*F25B 41/00* (2006.01)

(52) U.S. Cl. ..... 62/513; 62/113; 165/140; 165/175; 236/34

(58) Field of Classification Search ..... 62/513, 62/113; 236/34; 165/175, 140
See application file for complete search history.

(56) References Cited

U.S. PATENT DOCUMENTS

| | | | | |
|---|---|---|---|---|
| 5,168,925 | A * | 12/1992 | Suzumura et al. | 165/176 |
| 5,275,233 | A * | 1/1994 | Little | 165/111 |
| 5,544,498 | A | 8/1996 | Benedict | 62/513 |
| 6,189,334 | B1 | 2/2001 | Dienhart et al. | 62/507 |
| 6,539,746 | B1 * | 4/2003 | Haussmann | 62/513 |
| 6,745,827 | B2 * | 6/2004 | Lee et al. | 165/144 |
| 2004/0216863 | A1 * | 11/2004 | Hu | 165/110 |
| 2006/0016214 | A1 * | 1/2006 | Gorbounov et al. | 62/513 |

* cited by examiner

*Primary Examiner*—Cheryl J Tyler
*Assistant Examiner*—Justin Loffredo
(74) *Attorney, Agent, or Firm*—Patrick M. Griffin

(57) ABSTRACT

A gas cooler and heat exchanger assembly comprises a gas cooler, including a cylindrical inlet header and a cylindrical outlet header, and a heat exchanger, including a first tank and a second tank, with at least a portion of each of the tanks being cylindrical and being an extension of and integral with each of the associated and aligned headers. In the first embodiment, the entirety of each of the tanks is cylindrical in shape and extends from the associated header. Each of the tanks is bisected thus defining a semi-cylindrical hot chamber and a semi-cylindrical cool chamber. In the second embodiment, only the cylindrical hot chamber of each of the tanks is cylindrical in shape and extends from the associated header. An additional box-shaped structure defines a box-shaped cool chamber disposed along and inwardly of each of the cylindrical hot chambers.

12 Claims, 3 Drawing Sheets

INTERNAL HEAT EXCHANGER INTEGRATED WITH GAS COOLER

BACKGROUND OF THE INVENTION

1. Field of the Invention

The present invention relates to an air conditioning assembly for cooling.

2. Description of the Prior Art

Most automotive air conditioning assemblies comprise a compressor, a gas cooler, an expansion device, and an evaporator. Conventional refrigerants include R 134*a* and R 744 (Carbon Dioxide). The air conditioning assemblies that utilize R 134*a* as the refrigerant typically operate such that the critical pressure of the refrigerant is not exceeded. Heat supply and heat removal take place via evaporation and condensation of the refrigerant and there is no need for an internal heat exchanger.

However, in the air conditioning assemblies that utilize R 744 as the refrigerant, the pressure of the refrigerant in the system may become higher than the critical pressure of the refrigerant. Under this condition, the fluid exiting the gas cooler remains a high pressure, high temperature vapor. Also, the vapor exiting the evaporator contains a fraction of low pressure, low temperature residual liquid. The cooling of the high temperature, high pressure gas with the low temperature fluid exiting the evaporator improves the efficiency level of the assembly. To obtain an efficiency level equal to or better than an assembly utilizing R 134*a* as a refrigerant, it is necessary to use a heat exchanger in fluid communication with the gas cooler, the expansion device and the evaporator.

Typically, the gas cooler is located in the front of the vehicle and the compressor is located away from the gas cooler and closer to the evaporator. These physical restrictions make it impractical to use a heat exchanger without compromising the overall performance of the air conditioning assembly. As such, when there is a need for an internal heat exchanger, the internal heat exchanger is often manufactured and installed separately. Such an internal heat exchanger may be a suction line heat exchanger, which cools the fluid leaving the condenser (in a traditional refrigerant system) or the gas cooler (in an R 744 system). In an R 744 system, when an accumulator/dehydrator is placed at the front of the vehicle for packaging purposes, a suction line has to be routed to the front of the vehicle. In such cases, the most beneficial location of the internal heat exchanger is near the gas cooler at the front of the vehicle. The combination of the separate installation of the heat exchanger and the positioning of the heat exchanger at the front of the vehicle results in increased assembly costs and additional connection equipment.

The U.S. Pat. No. 5,544,498 to Benedict discloses an air conditioning assembly including a compressor, a gas cooler, an expansion device, an evaporator, and a heat exchanger. The heat exchanger is used to remove residual vapor from liquid refrigerant and residual liquid from vapor refrigerant as the refrigerant circulates through the system. The U.S. Pat. No. 6,189,334 to Dienhart, et al. provides for a similar air conditioning assembly with the heat exchanger and the gas cooler in one constructional unit.

Although the prior art connects a heat exchanger to a gas cooler in an air conditioning system, the heat exchanger and the gas cooler are separately constructed and fabricated, i.e., the heat exchanger is essentially a separate component to the gas cooler.

SUMMARY OF THE INVENTION AND ADVANTAGES

The subject invention provides a gas cooler and heat exchanger assembly for condensing a refrigerant comprising a gas cooler including an inlet header extending along a first axis, an outlet header extending along a second axis parallel to and spaced from the first axis, and a plurality of condensing tubes extending between the headers for conveying refrigerant therebetween. A heat exchanger includes a first tank extending along the first axis from the inlet header and a second tank extending along the second axis from the outlet header. At least one hot tube extends between the tanks to define a hot passage and at least one cool tube extends between the tanks to define a cool passage.

The proposed invention provides a combined and unitary gas cooler and heat exchanger assembly wherein the heat exchanger is integrated with the gas cooler. The design is such that the gas cooler and the heat exchanger share elements or components and can be brazed together to yield a single or unitary assembly for use in an air conditioning system. As a result, component and fabrication costs are reduced.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
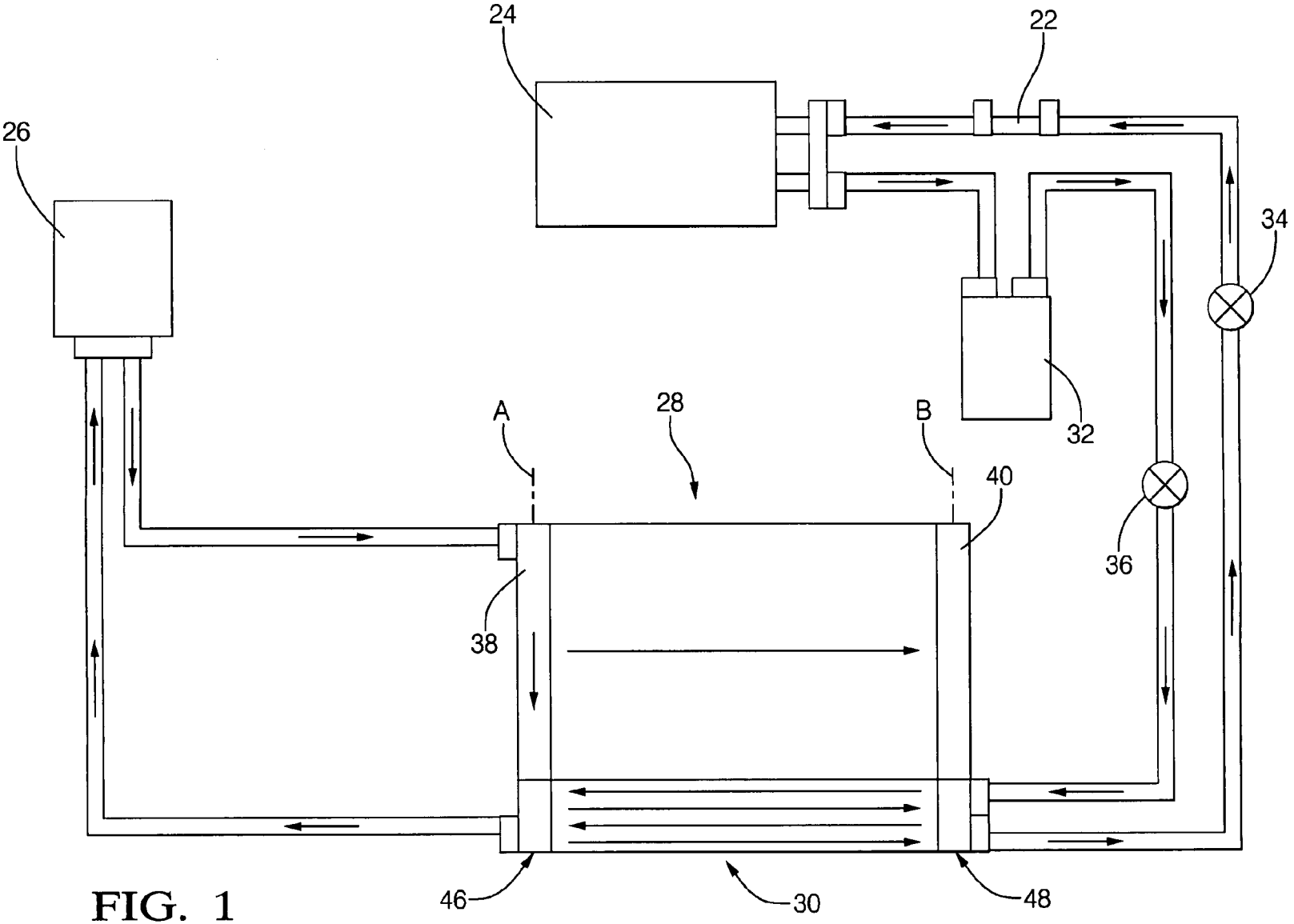
FIG. 1 is a schematic drawing of an air conditioning system showing flow of refrigerant.

Referring to the Figures, wherein like numerals indicate corresponding parts throughout the several views, an air conditioning assembly for cooling is generally shown in FIG. 1. The air conditioning assembly comprises an expansion device 22, an evaporator 24, a compressor 26, a gas cooler 28, and a heat exchanger 30 generally shown. The air conditioning assembly also includes an accumulator-dehydrator 32, a charge valve 34, and a service valve 36, all being well known in the art.

The expansion device 22 expands a refrigerant that is circulated through the assembly. The expansion device 22 is in fluid communication with and between the heat exchanger 30 and the evaporator 24. The expansion device 22 receives refrigerant from the heat exchanger 30, expands the refrigerant, and discharges the refrigerant to the evaporator 24. In other words, the expander de-pressurizes the incoming refrigerant and yields a lower temperature, lower pressure outgoing refrigerant.

The evaporator 24 receives the low-pressure liquid/gaseous refrigerant from the expansion device 22 and adds heat from an outside source to the refrigerant. This addition of heat causes the refrigerant to undergo a phase change from mostly liquid to all vapor. The refrigerant exiting the evaporator 24 is in the vapor state, but an amount of residual liquid remains in the evaporated refrigerant. The resultant vapor and liquid refrigerant is discharged from the evaporator 24 to the heat exchanger 30.

The compressor 26 is in fluid communication with the heat exchanger 30 and with the gas cooler 28 so as to be positioned therebetween. More specifically, the compressor 26 receives refrigerant from the heat exchanger 30, pressurizes the refrigerant, and discharges the refrigerant to the gas cooler 28. The pressure of the refrigerant exiting the compressor 26 is higher than that of the refrigerant entering the compressor 26.

Accordingly, refrigerant is pressurized by the compressor 26 and flows to the gas cooler 28. From the gas cooler 28, the refrigerant flows through the heat exchanger 30 in one direction to the evaporator 24, from which the refrigerant flows back through the heat exchanger 30 in the opposite direction, and then back to the compressor 26.

The gas cooler 28 includes a cylindrical inlet header 38 that extends along a vertical first axis A, and a cylindrical outlet header 40 that extends along a second axis B parallel to and spaced from the first axis A. A plurality of condensing tubes 42 extends between the headers 38, 40 for conveying refrigerant therebetween. A plurality of corrugated fins 44 is disposed between the condensing tubes 42. The inlet header 38 receives the pressurized vapor refrigerant from the compressor 26 and directs it to the condensing tubes 42. The fins 44 contact the condensing tubes 42 conveying the vapor refrigerant so that the fins 44 extract heat from the condensing tubes 42 and the refrigerant therein. The fins 44 transfer the heat into a stream of cooling air flowing over the fins 44 between adjacent condensing tubes 42. When the refrigerant temperature is below the critical temperature, the removal of heat causes the refrigerant to undergo a phase change from vapor to liquid, whereby the refrigerant exiting the gas cooler 28 is in the liquid state. However, when the refrigerant temperature exceeds the critical temperature, the removal of heat cases the high temperature vapor to exit at a lower temperature but still in the vapor phase.

The heat exchanger 30 is in fluid communication with and receives the refrigerant from the evaporator 24, which refrigerant flows through the heat exchanger 30 to the compressor 26. The heat exchanger 30 includes a first tank 46, generally indicated, that extends along the first axis A and downwardly from the inlet header 38 and a second tank 48, generally indicated, that extends along the second axis B and downwardly from the outlet header 40. At least one hot tube 50 extends between the tanks 46, 48 and at least one cool tube 52 extends between the tanks 46, 48. Each hot tube 50 defines a hot passage and each cool tube 52 defines a cool passage.

As alluded to above, a cylinder defines each of the headers 38, 40 and each cylinder defines an axially aligned and associated portion of one of said tanks 46, 48. In other words, a portion of each of the tanks 46, 48 is an extension of the cylinder aligned with and extending along the same axis as the associated one of the cylindrical headers 38, 40. The first tank 46 and the inlet header 38 both extend along the first axis A and a portion of the first tank 46 is an extension of the axially aligned inlet header 38. Similarly, the second tank 48 and the outlet header 40 extend along the second axis B and a portion of the second tank 48 is an extension of the axially aligned outlet header 40.

Figure 2:
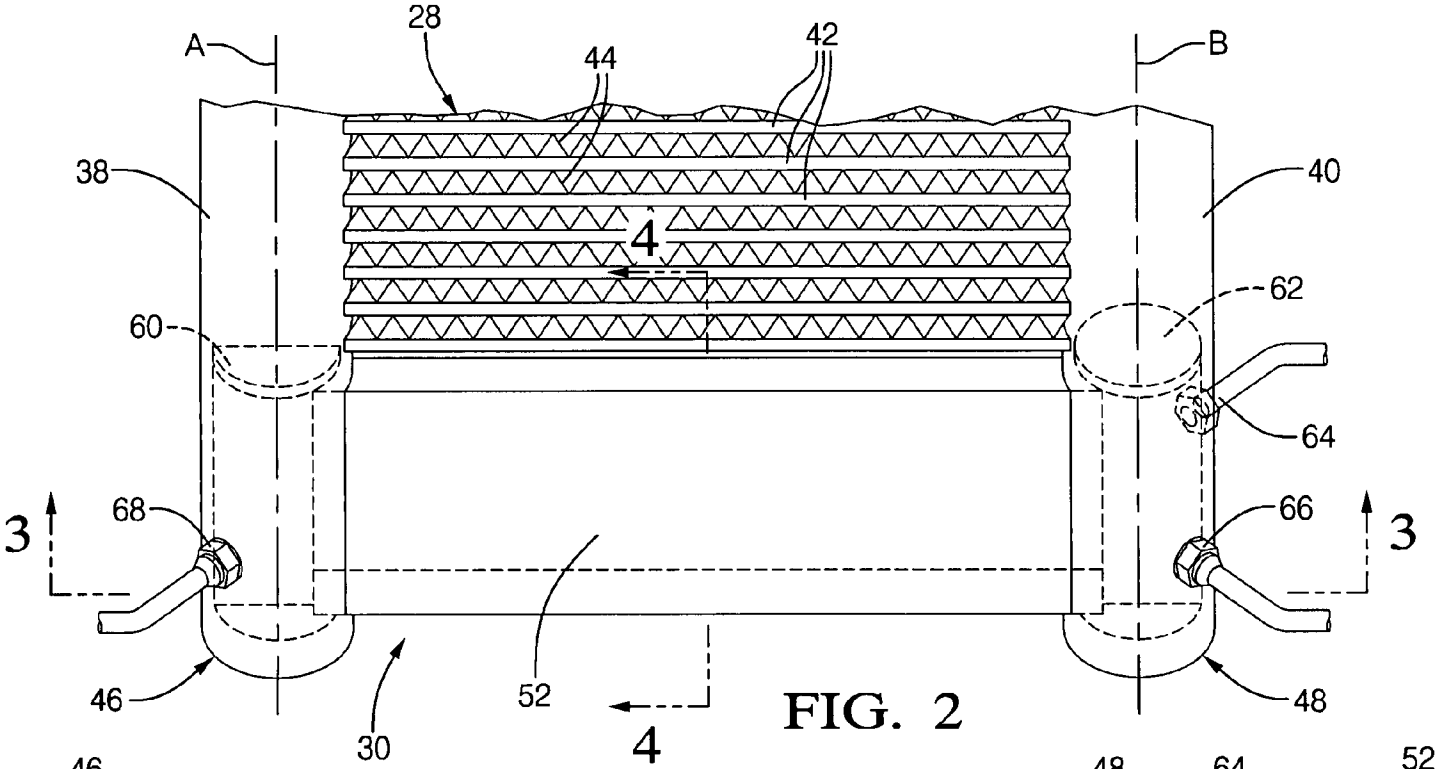
FIG. 2 is a fragmented front perspective view of a first embodiment of the invention.
Figure 3:
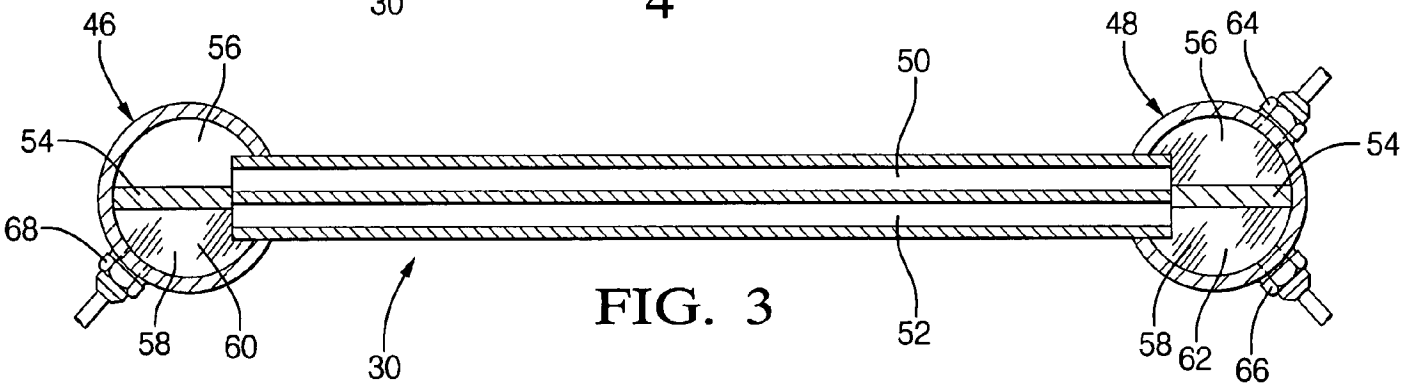
FIG. 3 is a cross sectional view taken along the line 3-3 of FIG. 2.
Figure 4:
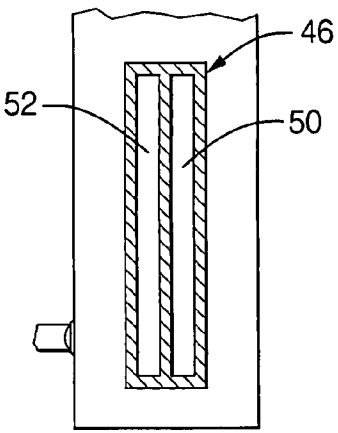
FIG. 4 is a cross sectional view taken along the line 4-4 of FIG. 2.

Referring to the first embodiment of FIGS. 2, 3, and 4, each of the tanks 46, 48 is cylindrical and an extension of and integral with the associated one of the aligned headers 38, 40. A partition 54 divides each of the cylindrical tanks 46, 48 into a semi-cylindrical hot chamber 56 and a semi-cylindrical cool chamber 58. The partition 54 in each of the cylindrical tanks 46, 48 extends diametrically on the diameter of the cylindrical tanks 46, 48. In other words, the partition 54 in each of the tanks 46, 48 bisects the circular cross section of each of the tanks 46, 48. The partition 54 in the first tank 46 extends downwardly along the first axis A and splits the cylindrical first tank 46 into the semi-cylindrical hot chamber 56 and the semi-cylindrical cool chamber 58, both disposed in the cylindrical first tank 46. Similarly, the partition 54 in the second tank 48 extends downwardly along the second axis B and splits the cylindrical second tank 48 into the semi-cylindrical hot chamber 56 and the semi-cylindrical cool chamber 58, both disposed the cylindrical second tank 48.

Continuing with the first embodiment, a semi-circular inlet separator 60 is disposed between the cylindrical inlet header 38 and the cylindrical first tank 46 to separate the interior of the inlet header 38 from the semi-cylindrical cool chamber 58 of the first tank 46 but not from the semi-cylindrical hot chamber 56 of the first tank 46, which is left open on top to receive refrigerant from the inlet header 38. The inlet separator 60 joins the partition 54 at the top of the first tank 46 to further define and close the semi-cylindrical cool chamber 58 so that there is no fluid communication between the inlet header 38 and the semi-cylindrical cool chamber 58. The remaining semi-cylindrical space in the first tank 46 becomes the semi-cylindrical hot chamber 56, which is a mirror image of the semi-cylindrical cool chamber 58 except that it is not closed on the top.

On the other end, a circular outlet separator 62 is disposed between the cylindrical outlet header 40 and the cylindrical second tank 48 to separate the entire circular interior of the outlet header 40 from both semi-cylindrical chambers 56, 58 of the second tank 48. The outlet separator 62 joins the partition 54 at the top of the second tank 48 to further define and close both the semi-cylindrical hot chamber 56 and the semi-cylindrical cool chamber 58 so that there is no fluid communication between the outlet header 40 and the semi-cylindrical chambers 56, 58.

In the first embodiment, a single hot tube 50 and a single cool tube 52 are disposed in a parallel and side-by-side relationship with one another. Both the hot tube 50 and the cool tube 52 have a rectangular cross section. The rectangular cross section extends longitudinally and axially along the tanks 46, 48. In other words, the tubes 50, 52 are box-shaped with the vertical heights being greater than the horizontal widths. The hot tube 50 extends between semi-cylindrical hot chambers 56, which are defined by each of the tanks 46, 48 and the cool tube 52 extends between semi-cylindrical cool chambers 58, which are defined by each of the tanks 46, 48. The semi-cylindrical hot chamber 56 of the first tank 46 receives refrigerant from the gas cooler 28 and directs the refrigerant into the hot tube 50, which directs the refrigerant to the semi-cylindrical hot chamber 56 of the second tank 48. The semi-cylindrical hot chamber 56 of the second tank 48 receives the refrigerant from the hot tube 50 and directs the refrigerant to the expansion device 22, via a hot outlet 64, from the semi-cylindrical hot chamber 56 of the second tank 48.

The semi-cylindrical cool chamber 58 of the second tank 48 of the heat exchanger 30 is in fluid communication with the evaporator 24 via a suction inlet 66 to receive refrigerant from the evaporator 24 and direct the refrigerant into the cool tube 52. The cool tube 52 directs the refrigerant received from the evaporator 24 from the semi-cylindrical cool chamber 58 of the second tank 48 to the semi-cylindrical cool chamber 58 of the first tank 46. The semi-cylindrical cool chamber 58 of the first tank 46 directs refrigerant from the cool tube 52 to the compressor 26 via a suction outlet 68.

As the refrigerant flows through the tubes 50, 52, heat is transferred between the hot and cool tubes 50, 52. The residual vapor in the refrigerant from the gas cooler 28 is cooled and undergoes a phase change from vapor to liquid. The residual liquid in the refrigerant from the evaporator 24 is heated and undergoes a phase change from liquid to vapor.

The suction inlet 66 extends into the semi-cylindrical cool chamber 58 of the second tank 48 and receives refrigerant from the evaporator 24. The suction outlet 68 extends out of the semi-cylindrical cool chamber 58 of the first tank 46 and discharges refrigerant from the semi-cylindrical cool chamber 58 of the first tank 46 to the compressor 26. The refrigerant flows from the suction inlet 66 to the semi-cylindrical cool chamber 58 of the second tank 48 through the cool tube 52 to the semi-cylindrical cool chamber 58 of the first tank 46 and out the suction outlet 68.

The opening in the top of the hot chamber of the first tank 46 serves as an inlet for refrigerant from the inlet header 38 of the gas cooler 28. The hot outlet 64 extends out of the semi-cylindrical hot chamber 56 of the second tank 48 and discharges refrigerant from the semi-cylindrical hot chamber 56 of the second tank 48 to the expansion device 22. The refrigerant flows from the semi-cylindrical hot chamber 56 of the first tank 46 through the hot tube 50 to the semi-cylindrical hot chamber 56 of the second tank 48 and out the hot outlet 64.

Figures 5, 6, 7:
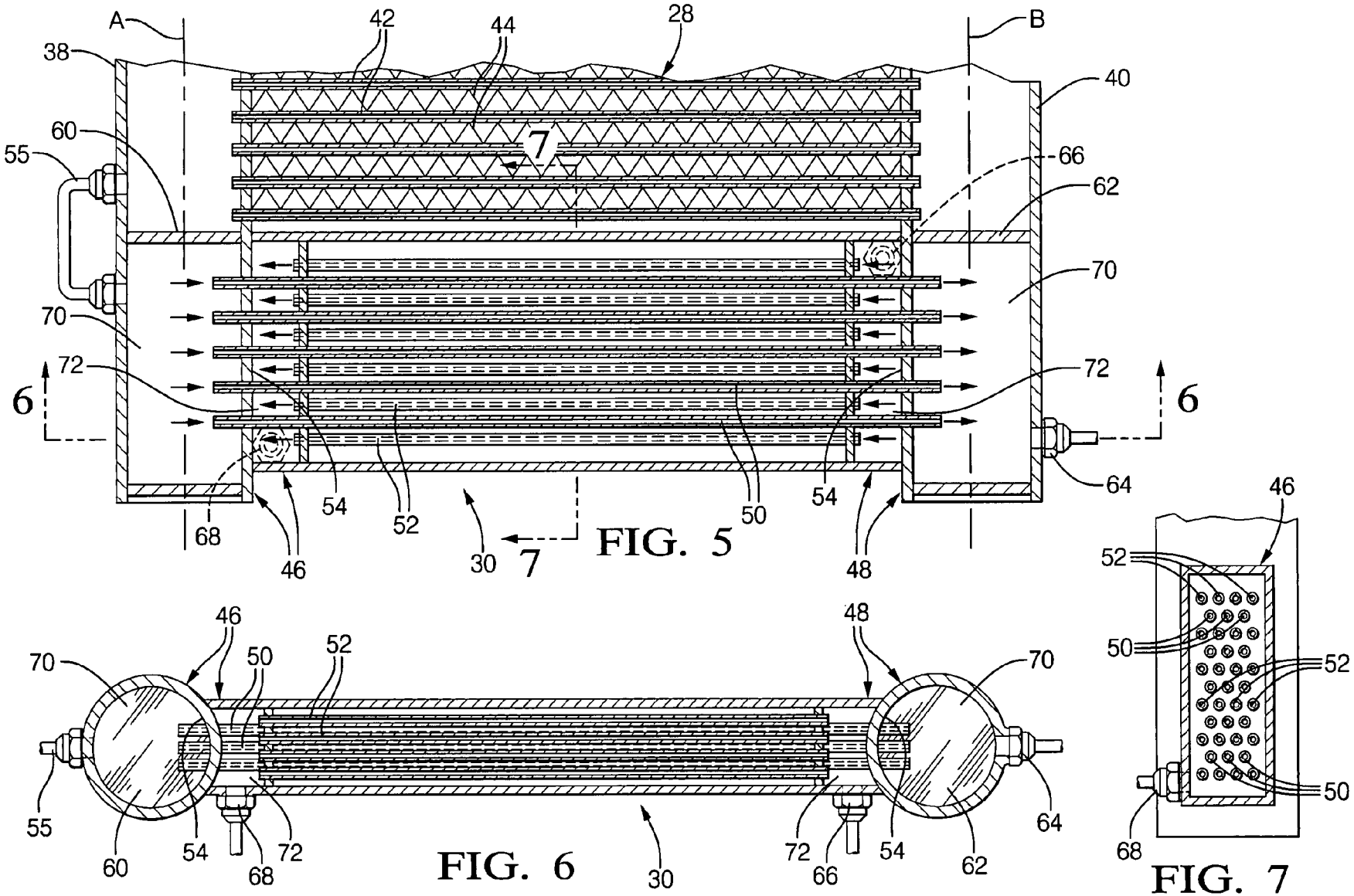
FIG. 5 is a fragmented front perspective view of a second embodiment of the invention.
FIG. 6 is a cross sectional view taken along the line 6-6 of FIG. 5.
FIG. 7 is a cross sectional view taken along the line 7-7 of FIG. 5.

In the second embodiment shown in FIGS. 5, 6, and 7, only a cylindrical hot chamber 70 portion of each of the tanks 46, 48 is cylindrical and an extension of and integral with the respective one of the associated and aligned headers 38, 40. A section of the side wall of the cylinder defines a partition 54 extending the length of each of the tanks 46, 48 and divides each of the tanks 46, 48 into the cylindrical hot chamber 70 and a box-shaped cool chamber 72. In other words, the axially aligned and associated cylindrical hot chamber 70 portions of the tanks 46, 48 extend from and are defined by the cylinders of the respective cylindrical headers 38, 40. These extending portions define each cylindrical hot chamber 70 as being circular in cross section. In other words, the cylindrical hot chambers 70 form a cylindrical shape as they extend downwardly from the respective headers 38, 40 and along the respective axes A, B. A box-shaped cool chamber 72 defines the remaining portion of each of the tanks 46, 48 and is rectangular in cross section. In other words, each of the box-shaped cool chambers 72 forms a box-like shape and extends downwardly along and inwardly of the respective cylindrical hot chamber 70 whereby that section of each cylinder covered by a box-shaped cool chamber 72 defines the partition 54 in each of the tanks 46, 48 to separate the cylindrical hot chamber 70 from the box-shaped cool chamber 72.

A circular inlet separator 60 is disposed between the inlet header 38 and the first tank 46 to separate the entire interior of the inlet header 38 from the cylindrical hot chamber 70 of the first tank 46. The inlet separator 60 joins the partition 54 at the top of the first tank 46 to further define and close the cylindrical hot chamber 70. A hot inlet 55 is defined by the circular inlet separator 60. The hot inlet 55 is an aperture that conveys refrigerant from the inlet header 38 into the cylindrical hot chamber 70 of the first tank 46. Alternatively, the hot inlet 55 can be eliminated and an internal passage can be created in the circular inlet separator 60.

Similarly, a circular outlet separator 62 is disposed between the outlet header 40 and the second tank 48 to separate the entire interior of the outlet header 40 from the cylindrical hot chamber 70 of the second tank 48. The outlet separator 62 joins the partition 54 at the top of the second tank 48 to further define and close the cylindrical hot chamber 70 so that there is no fluid communication between the outlet header 40 and the cylindrical hot chamber 70 of the second tank 48.

A plurality of hot tubes 50 and a plurality of cool tubes 52 are disposed in a parallel and side-by-side relationship with one another. Each of the hot tubes 50 and each of the cool tubes 52 define a circular cross section. Each hot tube 50 extends between the cylindrical hot chambers 70, and each cool tube 52 extends between box-shaped cool chambers 72. The suction inlet 66 extends into the box-shaped cool chamber 72 of the second tank 48 and receives refrigerant from the evaporator 24. The suction outlet 68 extends out of the box-shaped cool chamber 72 of the first tank 46 and discharges refrigerant from the box-shaped cool chamber 72 of the first tank 46 to the compressor 26. The refrigerant flows from the suction inlet 66 to the box-shaped cool chamber 72 of the second tank 48 through the cool tubes 52 to the box-shaped cool chamber 72 of the first tank 46 and out the suction outlet 68.

The hot inlet 55 leads into the cylindrical hot chamber 70 of the first tank 46 and conveys refrigerant from inlet header 38 of the gas cooler 28. The hot outlet 64 extends out of the cylindrical hot chamber 70 of the second tank 48 and discharges refrigerant from the cylindrical hot chamber 70 of the second tank 48 to the expansion device 22. The refrigerant flows from the hot inlet 55 to the cylindrical hot chamber 70 of the first tank 46 through the hot tubes 50 to the cylindrical hot chamber 70 of the second tank 48 and out the hot outlet 64.

Although the embodiments of the invention vary slightly in structure, they include the same combination of elements. Both embodiments of the invention have at least one hot tube 50 and at least one cool tube 52 extending between the tanks 46, 48. The first embodiment has only one hot tube 50, while the second embodiment has a plurality of hot tubes 50. Similarly, the first embodiment has only one cool tube 52, while the second embodiment has a plurality of cool tubes 52. The tubes 50, 52 if either embodiment may be of any cross sectional shape and may vary in number.

A portion of each of the tanks 46, 48 is an extension of the respective axially aligned header in both embodiments. In the first embodiment, the entirety of each of the tanks 46, 48 is a cylindrical extension of the respective header, while in the second embodiment, only the cylindrical hot chamber 70 portion of each of the tanks 46, 48 is an extension of the respective header.

Both embodiments include a partition 54 dividing the tanks 46, 48 into a hot chamber and a cool chamber. In the first embodiment, the partition 54 splits each tank into a semi-cylindrical hot chamber 56 and a semi-cylindrical cool chamber 58, each a mirror image of the other. However, the partition 54 of the second embodiment divides each tank into a cylindrical hot chamber 70 and a box-shaped cool chamber 72.

Both embodiments include an inlet separator 60 in the first tank 46 for separating the interior of the inlet header 38 from at least one of the hot chamber and the cool chamber. In the first embodiment, only the semi-cylindrical cool chamber 58 is separated from the interior of the inlet header 38. The semi-cylindrical hot chamber 56 is left open to serve as an inlet for refrigerant. The inlet separator 60 of the second embodiment separates the entire inlet header 38 from the cylindrical hot chamber 70.

Both embodiments include an outlet separator 62 in the second tank 48 for separating the interior of the outlet header 40 from at least one of the hot chamber and the cool chamber. In the first embodiment, both the semi-cylindrical cool chamber 58 and the semi-cylindrical hot chamber 56 are separated from the interior of the outlet header 40. The outlet separator 62 of the second embodiment separates the outlet header 40 from only the cylindrical hot chamber 70.

The alignment of the tanks 46, 48 with their respective headers 38, 40 allows the tanks 46, 48 to be integral with their respective headers 38, 40 thereby greatly simplifying the manufacturing and fabrication processes. In other words, the headers 38, 40 and tanks 46, 48 can be pre-fabricated with the condensing tubes 42 and the hot tubes 50 and the cool tubes 52 and placed in a brazing oven to be brazed together. The need for additional connections and componentry is significantly reduced.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An air conditioning assembly for cooling comprising;

a compressor for compressing refrigerant, a gas cooler for cooling and condensing refrigerant from said compressor, an expansion device for expanding refrigerant, an evaporator for evaporating the refrigerant from said expansion device, a heat exchanger having a hot passage for the flow of refrigerant therethrough from said gas cooler to said expansion device and a cool passage for the flow of refrigerant therethrough from said evaporator to said compressor for exchanging heat between said passages, said gas cooler including an inlet header being circular in cross section and extending along a first axis and in fluid communication with said compressor and an outlet header being circular in cross section and extending along a second axis parallel to and spaced from said first axis and a plurality of condensing tubes extending between said headers for conveying refrigerant therebetween, said heat exchanger including a first tank being circular in cross section and extending along said first axis from said inlet header and a second tank being circular in cross section and extending along said second axis from said outlet header and at least one hot tube extending between said tanks to define said hot passage and at least one cool tube extending between said tanks to define said cool passage, at least a portion of each of said tanks being an extension of said respective axially aligned header, at least a portion of each of said tanks being integral with said respective axially aligned header, a partition dividing each of said tanks into a hot chamber and a cool chamber, an inlet separator for separating the interior of said inlet header from at least one of said hot chamber and said cool chamber of said first tank, an outlet separtor for separating the interior of said outlet header from at least one of said hot chamber and said cool chamber of said second tank, said hot tube extending between said hot chamber of said first tank and said hot chamber of said second tank and said cool tube extending between said cool chamber of said first tank and said cool chamber of said second tank, and a homogenous cylinder defining each of said headers and at least an axially aligned and associated portion of one of said tanks.

2. An assembly as set forth in claim 1 including said partition in each of said tanks extending diametrically on the diameter of said cylindrical tank to define a semi-cylindrical hot chamber and a semi-cylindrical cool chamber being semi-circular in cross section.

3. An assembly as set forth in claim 2 wherein said inlet separator joins said partition in said first tank and extends to a rounded periphery to close said semi-cylindrical cool chamber therein and to separate said semi-cylindrical cool chamber of said first tank from the interior of said inlet header.

4. An assembly as set forth in claim 3 wherein said outlet separator joins said partition in said second tank and extends to a rounded periphery to close said semi-cylindrical hot chamber and said semi-cylindrical cool chamber therein to separate said semi-cylindrical chambers of said second tank from the interior of said outlet header.

5. An assembly as set forth in claim 4 wherein said hot tube and said cool tube are disposed in parallel and side-by-side relationship with one another.

6. An assembly as set forth in claim 5 wherein said hot tube and said cool tube each define a rectangular cross section extending longitudinally and axially along said tanks.

7. An assembly as set forth in claim 6 including a suction outlet in said first tank leading from said semi-cylindrical cool chamber for discharging refrigerant from said semi cylindrical cool chamber to said compressor, a suction inlet in said second tank leading into said semi-cylindrical cool chamber for receiving refrigerant from said evaporator, and a hot outlet in said second tank leading from said semi-cylindrical hot chamber for discharging refrigerant from said semi-cylindrical hot chamber to said expansion device.

8. An assembly as set forth in claim 1 including said portion of each of said tanks being defined by said extension of said cylinder and defining a cylindrical hot chamber as being circular in cross section, and each of said tanks defining a box-shaped cool chamber being rectangular in cross section and extending along and inward of said cylindrical hot chamber with said partition disposed therebetween.

9. An assembly as set forth in claim 8 including said inlet separator being circular and disposed in said cylinder between said cylindrical hot chamber of said first tank and the interior of said cylindrical inlet header.

10. An assembly as set forth in claim 9 including said outlet separator being circular and disposed in said cylinder between said cylindrical hot chamber of said second tank and the interior of said cylindrical outlet header.

11. An assembly as set forth in claim 10 including a plurality of said hot tubes and a plurality of said cool tubes extending in parallel and side-by-side relationship with one another.

12. An assembly as set forth in claim 11 including a hot inlet in said first tank leading into said cylindrical hot chamber for receiving refrigerant from said gas cooler, a suction outlet in said first tank leading from said box-shaped cool chamber for discharging refrigerant from said box-shaped cool chamber to said compressor, a suction inlet in said second tank leading into said box-shaped cool chamber for receiving refrigerant from said evaporator, and a hot outlet in said second tank leading from said cylindrical hot chamber for discharging refrigerant from said cylindrical hot chamber to said expansion device.

* * * * *